US008055171B2

(12) United States Patent
Ueyama et al.

(10) Patent No.: US 8,055,171 B2
(45) Date of Patent: Nov. 8, 2011

(54) PROCESS CARTRIDGE AND IMAGE FORMING APPARATUS WITH GUIDE PLATE

(75) Inventors: Junki Ueyama, Nagoya (JP); Hiroshi Tokuda, Aichi-ken (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 529 days.

(21) Appl. No.: 12/127,247

(22) Filed: May 27, 2008

(65) Prior Publication Data

US 2008/0298859 A1 Dec. 4, 2008

(30) Foreign Application Priority Data

May 30, 2007 (JP) ..... 2007-143274

(51) Int. Cl.
*G03G 15/16* (2006.01)

(52) U.S. Cl. ..... 399/316; 399/388

(58) Field of Classification Search ..... 399/316, 399/388

See application file for complete search history.

(56) References Cited

U.S. PATENT DOCUMENTS

| | | | | |
|---|---|---|---|---|
| 5,321,477 | A | 6/1994 | Nagata et al. | |
| 5,692,744 | A | 12/1997 | Funato | |
| 5,713,063 | A * | 1/1998 | Oono | 399/66 |
| 6,493,534 | B2 | 12/2002 | Sawanaka et al. | |
| 7,113,734 | B2 | 9/2006 | Deguchi et al. | |
| 2001/0010769 | A1 * | 8/2001 | Ishii et al. | 399/388 |
| 2005/0069343 | A1 * | 3/2005 | Deguchi et al. | 399/111 |
| 2006/0171760 | A1 | 8/2006 | Deguchi | |

FOREIGN PATENT DOCUMENTS

| | | |
|---|---|---|
| JP | 61-027153 | 2/1986 |
| JP | 04-144350 | 5/1992 |
| JP | 04-314075 | 11/1992 |
| JP | 05-046031 | 2/1993 |
| JP | 05-046033 | 2/1993 |
| JP | 06-179540 | 6/1994 |
| JP | 07-309476 | 11/1995 |
| JP | 2001-213544 | 8/2001 |
| JP | 2001-328747 | 11/2001 |
| JP | 2001-341890 | 12/2001 |
| JP | 2005-128482 | 5/2005 |
| JP | 2006-208839 | 8/2006 |

OTHER PUBLICATIONS

Notification of Reason for Refusal dated Mar. 17, 2009 in Japanese Application 20007-143274 with translation.

* cited by examiner

*Primary Examiner* — Ryan Walsh
(74) *Attorney, Agent, or Firm* — Banner & Witcoff, Ltd.

(57) ABSTRACT

A process cartridge according to one aspect of the invention comprises: an image carrier configured to carry a developer image and having a transfer position capable of transferring the developer image to a recording sheet; and an elastically-deformable cantilever-shaped guide plate including a distal end portion being unsupported, and having a first surface and a second surface that is opposite to the first surface. A leading end of the recording sheet is guided on the first surface in a conveying direction, such that the leading end is guided toward the transfer position after the leading end is brought into contact with the image carrier. The distal end portion of the guide plate is bent toward the second surface side to form a bent portion.

21 Claims, 6 Drawing Sheets

PROCESS CARTRIDGE AND IMAGE FORMING APPARATUS WITH GUIDE PLATE

CROSS-REFERENCE TO RELATED APPLICATIONS

This application is based upon and claims the benefit of priority from Japanese Patent Application No. 2007-143274, filed on May 30, 2007, the entire contents of which are incorporated herein by reference.

TECHNICAL FIELD

One aspect of the present invention relates to a process cartridge having a guide plate configured to guide a sheet to an image carrier such as a photosensitive drum, and an image forming apparatus.

BACKGROUND

In general, in an electrophotographic image forming apparatus such as a laser printer, a photosensitive drum configured to carry a developer image contacts with a transfer roller applied with a transfer bias for attracting the developer image. When a sheet passes through a space between the photosensitive drum and the transfer roller, the developer image moves toward the transfer roller, whereupon the developer image is transferred to the sheet, to thus form an image. Incidentally, in such an image forming apparatus, when the photosensitive drum is separated from the sheet at a position upstream of a transfer position (which is located between the photosensitive drum and the transfer roller) with respect to the direction of a conveyance of a sheet, a developer will disperse if electric discharge arises in the space, thereby staining the sheet with the dispersed developer (a so-called preliminary transfer).

In relation to such circumstances, JP-A-2005-128482 discloses bringing a leading end of a sheet into contact with a photosensitive drum by means of a guide plate formed from a flexible film and subsequently guiding the sheet toward a transfer position, thereby preventing occurrence of a preliminary transfer.

However, when a guide plate is formed from a flexible film as in the previously-described technique, the guide plate that has remained deflected thus far returns to its original position when a trailing end (an upstream end) of the sheet passes by the guide plate, thereby causing vibrations. This may generate a noise.

SUMMARY

One aspect of the present invention has an object to provide a process cartridge capable of preventing generation of noise, which would otherwise be induced by vibration of a guide plate, as well as provide an image forming apparatus.

According to an aspect of the invention, there is provided a process cartridge comprising: an image carrier configured to carry a developer image and having a transfer position capable of transferring the developer image to a recording sheet; and an elastically-deformable cantilever-shaped guide plate including a distal end portion being unsupported, and having a first surface and a second surface that is opposite to the first surface, wherein a leading end of the recording sheet is guided on the first surface in a conveying direction, such that the leading end is guided toward the transfer position after the leading end is brought into contact with the image carrier, wherein the distal end portion of the guide plate is bent toward the second surface side to form a bent portion.

According to another aspect of the invention, there is provided an image forming apparatus comprising a mounting portion to which a process cartridge is removably mountable, the process cartridge comprising: an image carrier configured to carry a developer image and having a transfer position capable of transferring the developer image to a recording sheet; and an elastically-deformable cantilever-shaped guide plate including a distal end portion being unsupported, and having a first surface and a second surface that is opposite to the first surface, wherein a leading end of the recording sheet is guided on the first surface in a conveying direction, such that the leading end is guided toward the transfer position after the leading end is brought into contact with the image carrier, wherein the distal end portion of the guide plate is bent toward the second surface side to form a bent portion.

According to still another aspect of the invention, there is provided an image forming apparatus comprising: main body; an image carrier configured to carry a developer image and having a transfer position capable of transferring the developer image to a recording sheet; and an elastically-deformable cantilever-shaped guide plate including a distal end portion being unsupported, and having a first surface and a second surface that is opposite to the first surface, wherein a leading end of the recording sheet is guided on the first surface in a conveying direction, such that the leading end is guided toward the transfer position after the leading end is brought into contact with the image carrier, wherein the distal end portion of the guide plate is bent toward the second surface side to form a bent portion, wherein the guide plate is provided at the main body.

DESCRIPTION

First Embodiment

<Overall Configuration of a Laser Printer>

Figure 1:
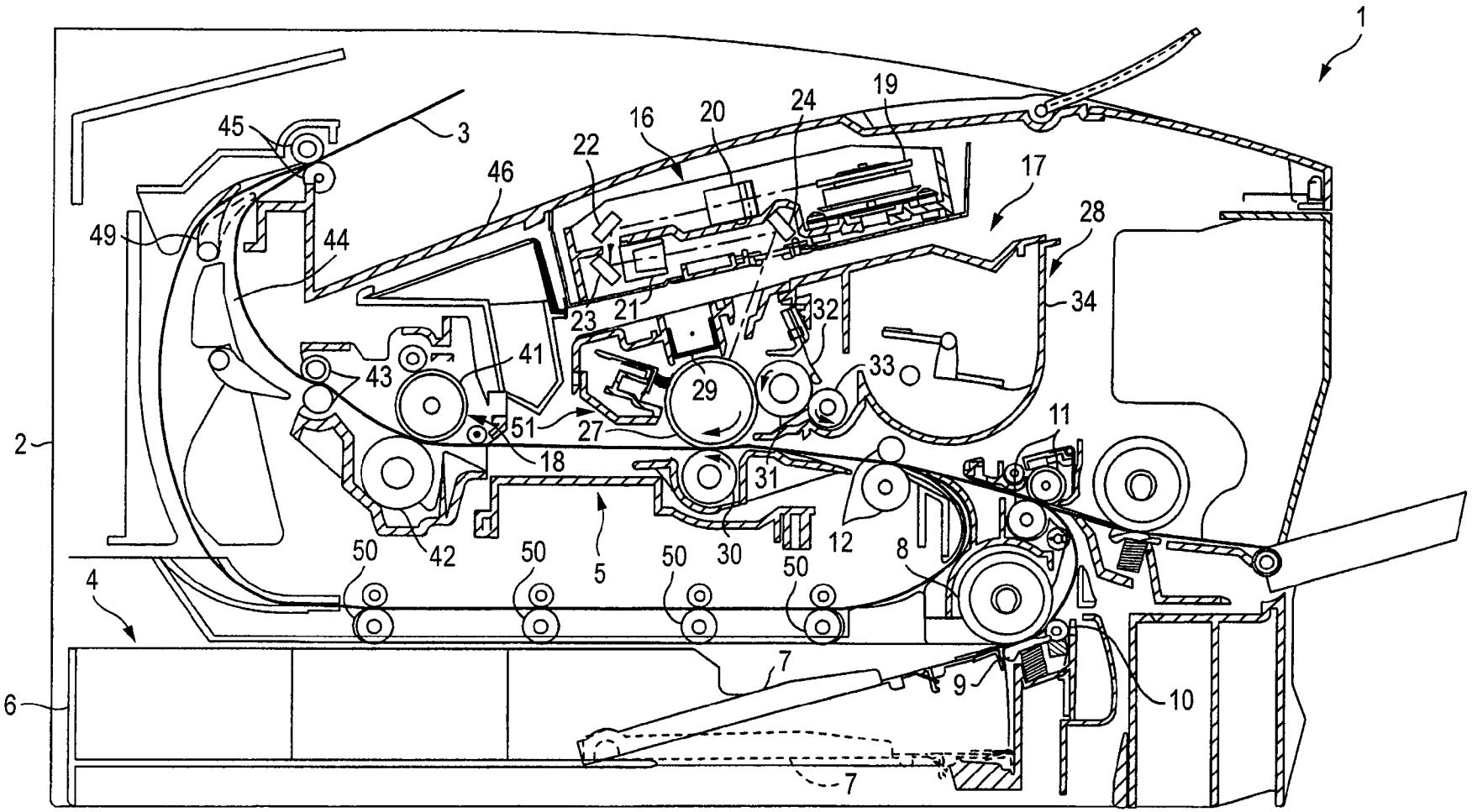
FIG. 1 is a side cross-sectional view showing a laser printer serving as an example image forming apparatus according to an embodiment of the present invention.

First, an overall configuration of a laser printer serving as an example image forming apparatus will be described. FIG. 1 is a side cross-sectional view showing a laser printer serving as an example image forming apparatus according to an embodiment of the present invention.

As shown in FIG. 1, the laser printer 1 includes a feeding unit 4 configured to feed a sheet 3 and an image forming unit 5 configured to form an image on the sheet 3 fed by the feeder unit. The feeder unit 4 and the image forming unit 5 are provided in a main body casing 2.

<Configuration of the Feeding Unit>

The feeding unit 4 includes a sheet feeding tray 6 removably mounted to a bottom area within the main body casing 2 and a sheet press plate 7 provided within the sheet feeding tray 6. The feeding unit 4 includes: a sheet feeding roller 8 and a sheet feeding pad 9 which are provided at positions above one lateral end of the sheet feeding tray 6; and paper dust removal rollers 10 and 11 disposed downstream of the sheet feeding roller 8 with respect to a conveying direction of the sheet 3. The feeding unit 4 further includes a registration roller 12 disposed downstream of the paper dust removal rollers 10 and 11. In the following descriptions, a downstream side or an upstream side with respect to the conveying direction of the sheet 3 may merely be called a "downstream" or an "upstream." In addition, a downstream end of the sheet 3 being conveyed may be referred to as a leading end, and an upstream end of the sheet 3 being conveyed may be referred to as a trailing end.

In the feeding unit 4 configured as mentioned above, the sheets 3 in the sheet feeding tray 6 are pushed toward the sheet feeding roller 8 by means of a sheet press plate 7. The sheets 3 are arranged so as to be fed by the sheet feeding roller 8 and the sheet feeding pad 9 and subsequently conveyed one at a time to the image forming unit 5 (more specifically a transfer position C, and see FIG. 2) after passing through the respective rollers 10 to 12.

<Configuration of the Image Forming Unit>

The image forming unit 5 has a scanner unit 16, a process cartridge 17, and a fixing unit 18.

<Configuration of the Scanner Unit>

The scanner unit 16 is disposed at an elevated position within the main body casing 2 and includes a laser emission unit (not shown), a rotationally-driven polygon mirror 19, lenses 20 and 21, reflection mirrors 22, 23 and 24, and the like. A laser beam originates from image data and is emitted by the laser emission unit. As indicated by a chain line, the laser beam sequentially passes through or undergoes reflection on the polygon mirror 19, the lens 20, the reflection mirrors 22 and 23, the lens 21, and the reflection mirror 24, and is radiated onto the surface of a photosensitive drum 27 of the process cartridge 17 by means of high-speed scanning operation.

<Configuration of the Process Cartridge>

The process cartridge 17 is disposed below the scanner unit 16 and is removably mountable to the main body casing 2. The process cartridge 17 includes a housing 51 and a developer cartridge 28 removably mountable to the housing 51.

The developer cartridge 28 has a developing roller 31, a layer thickness regulatory blade 32, a feed roller 33, and a toner hopper 34. Toner in the toner hopper 34 is fed to the developing roller 31 by means of rotation of the feed roller 33 in the direction of an arrow (a counterclockwise direction), and the toner is positively charged by means of friction between the feed roller 33 and the developing roller 31. The toner fed over the developing roller 31 enters a space between the layer thickness regulatory blade 32 and the developing roller 31 in association with rotation of the developing roller 31 in the direction of the arrow (the counterclockwise direction) and is held on the developing roller 31 as a thin layer of given thickness.

The housing 51 includes the photosensitive drum 27, a scorotron charger 29, and the transfer roller 30.

The photosensitive drum 27 is rotatably supported at the housing 51 in the direction of an arrow (a clockwise direction). In the photosensitive drum 27, a drum main body is grounded, and a surface of the drum main body is formed from a photosensitive layer possessing a positive electrostatic property.

The scorotron charger 29 is disposed above the photosensitive drum 27, while opposing and being spaced a given distance apart from the photosensitive drum 27, so as to avoid a contact with the photosensitive drum 27. The scorotron charger 29 is a charger of scorotron type for positive charge purpose that generates a corona discharge from a charging wire, such as tungsten; and is configured to evenly charge the surface of the photosensitive drum 27 with positive polarity.

The transfer roller 30 is disposed at a position below the photosensitive drum 27 so as to oppose and remain in contact with the photosensitive drum 27; and is rotatably supported at the housing 51 in the direction of the arrow (the counterclockwise direction). The transfer roller 30 a metal roller shaft and a conductive rubber material covered thereon. In transfer operation, a transfer bias is applied to the transfer roller 30 by means of constant current control operation. The transfer position C (see FIG. 2) is realized by a contact position (a nip position) between the transfer roller 30 and the photosensitive drum 27.

The surface of the photosensitive drum 27 is uniformly positively charged by means of the scorotron charger 29 and subsequently exposed to a high-speed scan of the laser beam emitted from the scanner unit 16. Thus, an electric potential of the exposed area is reduced, whereby an electrostatic latent image is formed on the basis of image data. Here, the "electrostatic latent image" corresponds to an exposed area on the uniformly, positively charged surface of the photosensitive drum 27 whose electric potential is reduced upon exposure to the laser beam. Next, when opposing and contacting the photosensitive drum 27, the toner held on the developing roller 31 is provided to the electrostatic latent image formed on the surface of the photosensitive drum 27 by means of rotation of the developing roller 31. The toner is selectively held on the surface of the photosensitive drum 27, to thus form a visible image, whereby a toner image is formed through reverse development.

Subsequently, the photosensitive drum 27 and the transfer roller 30 are rotationally driven, at the transfer position C shown in FIG. 2, so as to convey the sheet 3 while holding the sheet nipped therein. As a result, the sheet 3 is conveyed between the photosensitive drum 27 and the transfer roller 30, whereby the toner image held on the surface of the photosensitive drum 27 is transferred onto the sheet 3.

<Configuration of the Fixing Unit>

The fixing unit 18 is disposed downstream of the process cartridge 17 and includes a heating roller 41, a press roller 42 that is disposed opposite the heating roller 41 and presses the heating roller 41, and a pair of conveyance roller 43 disposed downstream of the heating roller 41 and the press roller 42. In the fixing unit 18 configured as mentioned above, the toner transferred onto the sheet 3 is thermally fixed in the middle of the sheet 3 passing between the heating roller 41 and the press roller 42. Subsequently, the sheet 3 is conveyed to a sheet discharge path 44 by means of a conveyance roller 43. The sheet 3 delivered to the sheet discharge path 44 is discharged onto a sheet discharge tray 46 by means of a sheet discharge roller 45, or the sheet 3 is returned to the inside of the apparatus by means of reverse rotation of the sheet discharge roller 45 and switching action of a flapper 49. The sheet is re-fed in an inverted manner to a position upstream of the image forming unit 5 by means of a plurality of reverse conveyance rollers 50 and subjected to double-sided printing.

<Structure of the Periphery of the Transfer Position>

Figure 2A:
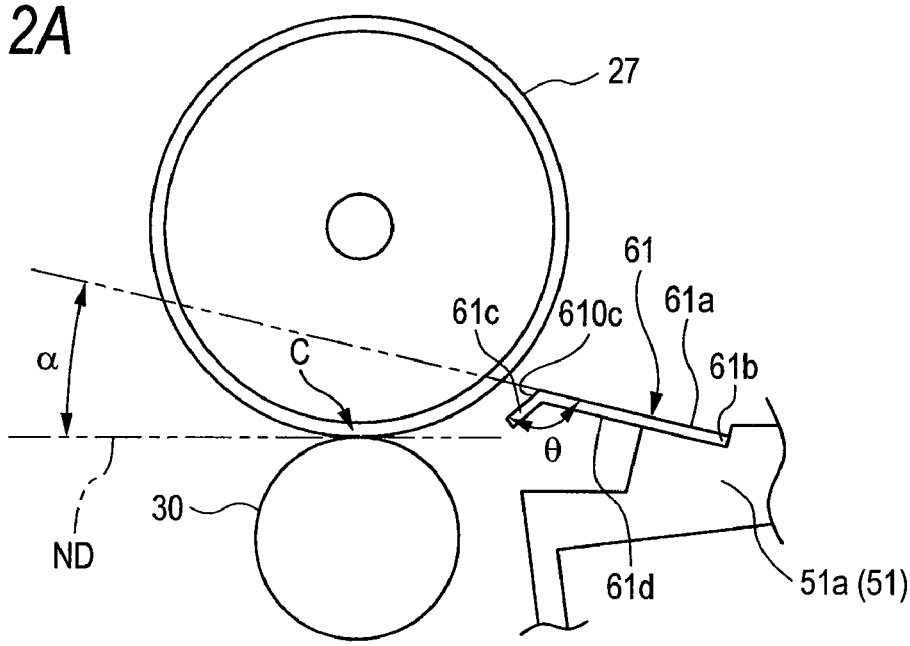
FIG. 2A is a side cross-sectional view and FIG. 2B is a perspective view, showing in a simplified manner the structure in a vicinity o a transfer position of a laser printer shown in FIG. 1.
Figure 2B:
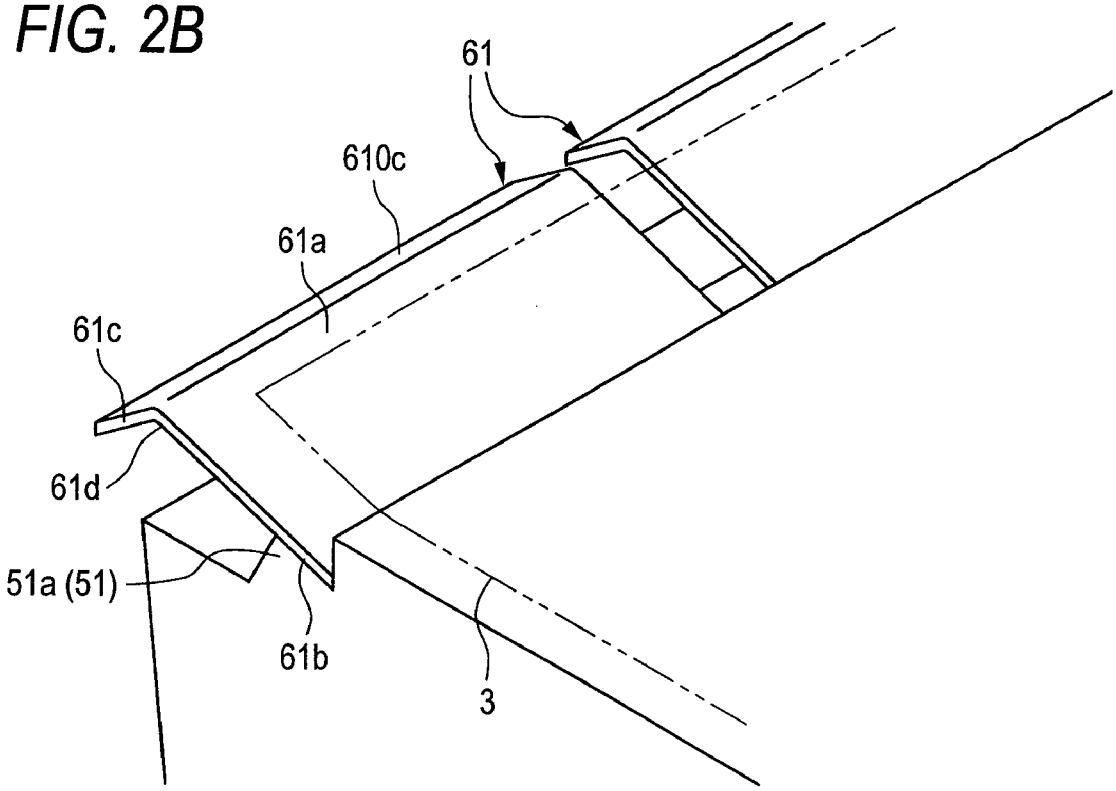

The structure of the periphery of the transfer position will now be described in detail. In the drawings to be referred to, FIG. 2A is a side cross-sectional view and FIG. 2B is a perspective view, and they show a simplified structure of a periphery of the transfer position of a laser printer shown in FIG. 1. For the sake of explanation, the structure of the periphery of the transfer position shown in FIG. 1 is omitted.

As shown in FIG. 2A, a guide plate 61 is provided at a position upstream of a contact portion (the transfer position C) between the photosensitive drum 27 and the transfer roller 30, and is configured to guide the leading end of the sheet 3 toward the transfer position C after bringing the leading end into contact with the photosensitive drum 27.

The guide plate 61 allows the sheet 3 to be guided toward the photosensitive drum 27 by means of an upper surface 61*a* of the guide plate 61. The guide plate is made of an elastically-deformable insulating material; for example, a resin such as polyethylene terephthalate, and is formed as an essentially-rectangular film member by means of pressing. The material, shape, and dimension of the guide plate 61 may be selected from a material harder than the softest recording sheet and/or softer than the hardest recording sheet of recording sheets used for the laser printer 1 (the sheets 3, such as thin paper, thick paper, postcards, and the like; and OHP sheets, and the like). For instance, when polyethylene terephthalate is selected as a material for the guide plate, the thickness of the guide plate (the thickness is along a direction orthogonal to the conveying direction and the widthwise direction) preferably falls within a range from 80 μm to 200 μm. Moreover, for example, a material in which a product EI of geometrical moment of inertia I and the Young's modulus E falls within a range from $3.49\times10^{-5}$ to $1.18\times10^{-3}$ (N·m2) may be selected.

As shown in FIG. 2B, the guide plate 61 of the embodiment has a width that is smaller than the width of the sheet 3 (a length of the sheet 3 along a direction orthogonal to the conveying direction among the directions along the surface of the sheet 3), and two guide plates 61 are provided in correspondence with the width of the sheet 3. The respective guide plates 61 are disposed in a left-right symmetrical position with respect to the center of the sheet 3 in the widthwise direction thereof, thereby appropriately supporting and carrying the sheet 3. When the guide plate 61 has a width greater than that of the sheet 3, only one guide plate 61 may be provided. In contrast, when the guide plate 61 has a width that is smaller than that of the guide plate of the present embodiment, three or more guide plates may be arranged side by side.

A base end portion 61*b* of the guide plate 61 (an upstream end in the conveying direction) is fastened to a pedestal 51*a*, and a distal end side (a downstream end in the conveying direction) of the guide plate 61 is unsupported and swayable (i.e., in a cantilever fashion). A vicinity of a distal end portion 61*c* of the guide plate 61 is bent toward a lower surface 61*d* opposite to an upper surface 61*a* of the guide plate 61 (a guide surface capable of contacting the sheet 3; and hereinafter also called a "guide surface 61*a*"). Thus, the distal end portion 61*c* of the guide plate 61 has a distal end surface 610*c* continuous from a downstream end of the guide surface 61*a* of the guide plate 61 in the conveying direction. Accordingly, the guide plate 61 includes a first portion corresponding to the base end portion 61*b*, a second portion corresponding to the distal end portion 61*c*, and a bent portion that connects the first portion and the second portion. The first portion has: a first surface corresponding to the guide surface 61*a*; and a second surface that is opposite to the first surface, which corresponds to the lower surface 61*d*. The second portion has a third surface continuous with the first surface, which corresponds to the distal end surface 610*c*.

More specifically, the base end portion 61*b* is fastened to the pedestal 51*a* such that the guide surface 61*a* of the guide plate 61 is inclined upwardly (in a direction from a point of center of the transfer roller 30 toward a point of center of the photosensitive drum 27) from an upstream position to a downstream position with respect to the conveying direction.

An inclination angle α (an inclination angle with respect to the of nip conveyance direction (ND)) of the guide surface 61*a* of the guide plate 61 preferably falls within 0° (degree) $<\alpha\leqq45°$, more preferably, $10°<\alpha\leqq35°$. Here, the "nip conveyance direction" in this embodiment is defined as a direction where a recording sheet is conveyed by means of an image carrier (the photosensitive drum 27) and a transfer member (the transfer roller 30). When both the image carrier and the transfer member have the shapes of rollers as in the present embodiment, the nip conveyance direction corresponds to a common tangential direction of the image carrier and the transfer member when viewed from the side (or a direction orthogonal to a direction connecting axes of the image carrier and the transfer member).

In the guide plate 61, a portion in the vicinity of the distal end portion 61*c* is bent such that an angle θ defined between the guide surface 61*a* and the distal end surface 610*c* on the lower surface 61*d* (i.e., the surface opposite to the guide surface 61*a*) side is 120° or less (98° in the embodiment).

Here, the upper surface of the pedestal 51*a* has the shape of a step, wherein a portion of the upper surface upstream of a position where the guide plate 61 is to be fastened is raised by an amount corresponding to the thickness of the guide plate 61 or more. As a result, a paper jam is prevented. The pedestal 51*a* is formed as a portion of the housing 51 of the process cartridge 17 (see FIG. 1). The pedestal 51*a* may be formed separately from the housing 51. The pedestal 51*a* may be formed at the main body casing 2 that is an example of the apparatus main body rather than on the process cartridge 17, and the guide plate 61 may also be provided at the main body casing 2.

According to the above descriptions, the present embodiment can yield the following advantage.

Since a portion in the vicinity of the distal end portion 61*c* of the guide plate 61 is bent at an appropriate angle toward the lower surface 61*d*, the rigidity of the guide plate 61 is appropriately increased, so that generation of noise, which would otherwise be caused by vibration of the guide plate 61, can be prevented as illustrated in connection with an example to be described below.

Second Embodiment

Figure 3:
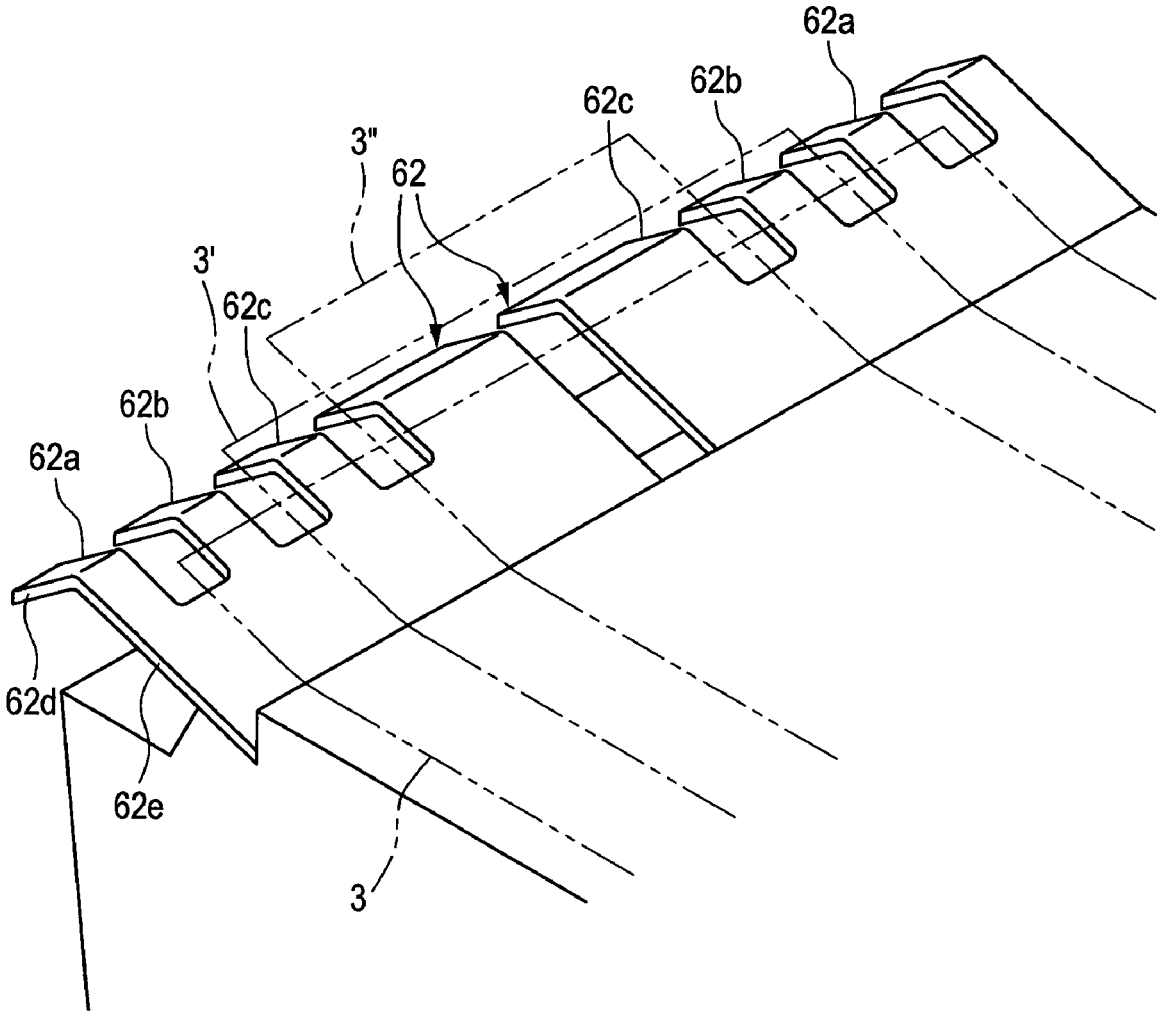
FIG. 3 is a perspective view showing a guide plate of a second embodiment.

A second embodiment of the present invention will now be described in detail with reference to the drawings. Since the present embodiment corresponds to the guide plate 61 of the first embodiment whose structure is partially altered. Hence, constituent elements which are the same as those of the first embodiment are assigned the same reference numerals, and their explanations can be omitted. FIG. 3 is a perspective view showing a guide plate of the second embodiment.

As shown in FIG. 3, a guide plate 62 of the second embodiment is formed from the same material as that of the guide plate 61 of the first embodiment, and the guide plate 62 is bent at the same angle as that of the guide plate 61. Further, slits 62*a*, 62*b*, and 62*c* are formed at positions of the guide plate 62 corresponding to both ends of the sheets 3, 3', and 3" with respect to the widthwise direction thereof. The respective slits

62*a*, 62*b*, and 62*c* are formed from a distal end side to a base end side of the guide plate 62 (i.e., the slits 62*a*, 62*b*, and 62*c* from the bent portion of the guide plate 62 to the distal end and the base end side). In more detail, the respective slits 62*a*, 62*b*, and 62*c* are formed from a distal end of the distal end portion 62*d* of the guide plate 62 to a vicinity of the center of a straight conveyance portion 62*e*. The respective slits 62*a*, 62*b*, and 62*c* are formed in numbers in conformance with a plurality of sizes of sheets 3, 3', and 3". In detail, a pair of slits 62*a* and 62*a* is formed in respective guide plates 62 in conformance with the sheet 3 having the largest width (e.g., an A4-size sheet). A pair of slits 62*b* and 62*b* is formed in conformance with the sheet 3' that is narrower than the sheet 3 (e.g., a B5-size sheet). Further, a pair of slits 62*c* and 62*c* is formed in conformance with the sheet 3" that is narrower than the sheet 3' (e.g., a postcard).

From the above descriptions, the second embodiment can yield the following advantage.

The slits 62*a*, 62*b*, and 62*c* are formed at positions of the guide plate 62 corresponding to both widthwise ends of the sheets 3, 3', and 3". Hence, there can be prevented generation of paper dust, which would otherwise be caused by a slide-contact arising between the guide plate 62 and both widthwise ends of the sheet 3, 3', or 3" during the course of the sheet 3, 3', or 3" passing over the guide plate 62. Since the respective slits 62*a*, 62*b*, and 62*c* are formed in conformance with the sheets 3, 3', and 3" of a plurality of sizes, generation of paper dust can be prevented regardless of the size of the sheet. Moreover, trailing ends at both widthwise ends of the sheets 3, 3', and 3" where force concentrates do not contact the guide plate 62 when passing over the guide plate 62. Consequently, there can be prevented generation of noise, which would otherwise be caused when the trailing ends at both widthwise ends of the sheets 3, 3', and 3" intensively flip the guide plate 62.

The present invention is not limited to the embodiment and can be utilized for various forms as illustrated below.

Figure 4A:
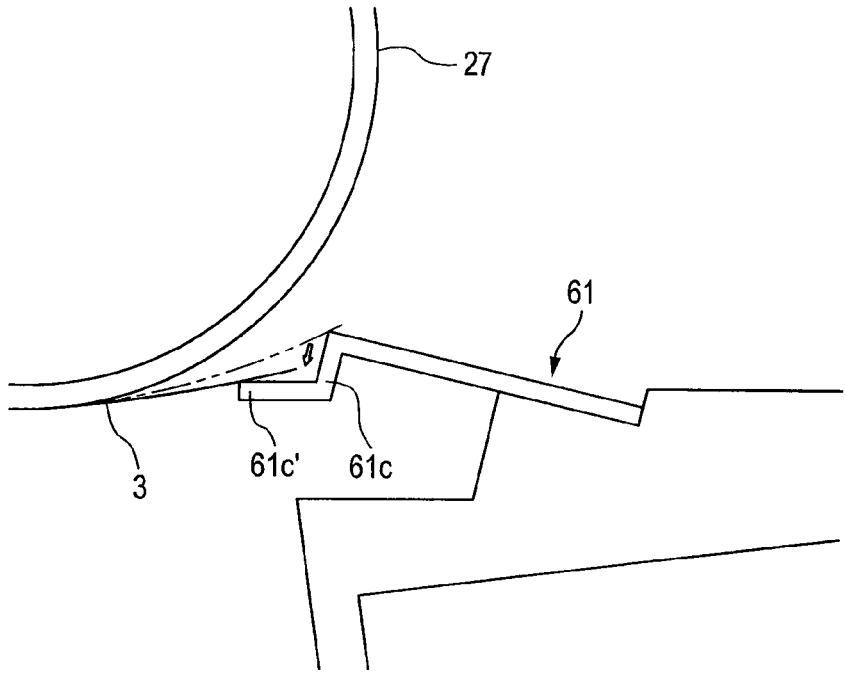
FIG. 4A is a side cross-sectional view showing an embodiment in which a distal end portion of a guide plate is bent further toward a downstream in a conveying direction.

In the respective embodiments, the distal end portion 61*c* and 62*d* of the guide plates 61 and 62 are respectively bent once. However, the present invention is not limited to the embodiments, and the distal end portion may also be bent a plurality of times. For instance, as shown in FIG. 4A, the bent distal end portion 61*c* of the guide plate 61 of the first embodiment may also be further bent downstream with respect to the conveying direction of the sheet 3 (i.e., towards the transfer position C side). By means of the configuration, downward movement of the trailing end of the sheet 3 passed over the guide plate 61 is regulated by a further-bent distal end portion 61*c'*, thereby preventing flapping of the trailing end of the sheet 3. As a result of flapping of the trailing end of the sheet 3 being prevented as mentioned above, noise resultant from flapping of the sheet 3 can be prevented, and an image can be produced appropriately.

Figure 4B:
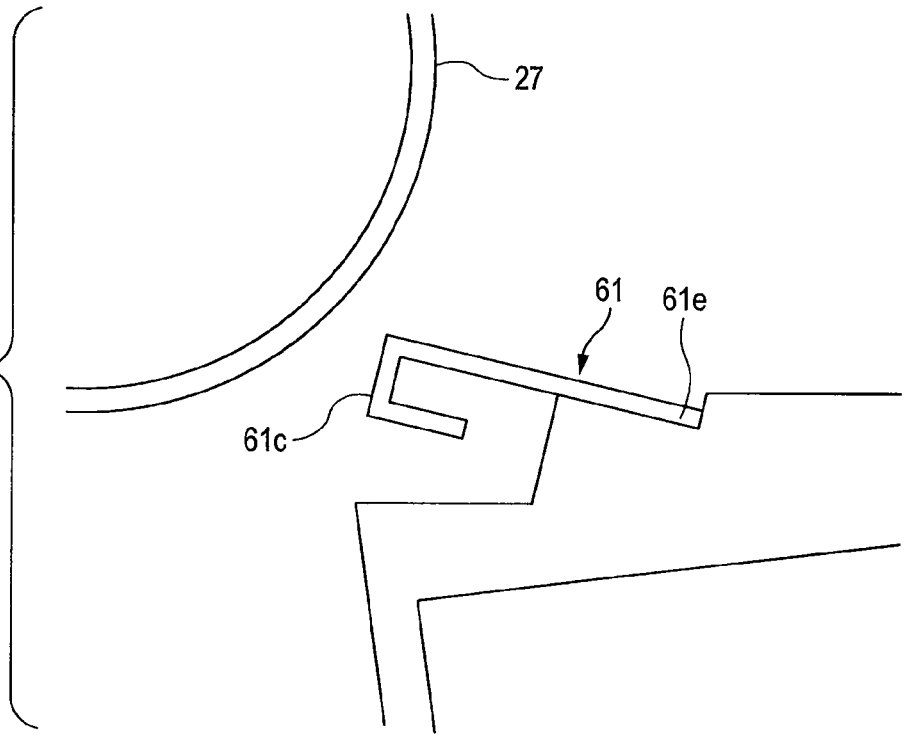
FIG. 4B is a side cross-sectional view showing an embodiment in which a distal end portion of a guide plate is bent further toward an upstream in the conveying direction.

As shown in FIG. 4B, the bent distal end portion 61*c* of the guide plate 61 of the first embodiment may also be bent further upstream with respect to the conveying direction of the sheet 3 (i.e., towards a side opposite to the transfer position C side). As a result, the rigidity of the distal end portion 61*c* of the guide plate 61 is increased, so that generation of noise, which would otherwise be caused as a result of vibration of the distal end portion 61*c*, can be prevented more reliably.

Figure 5:
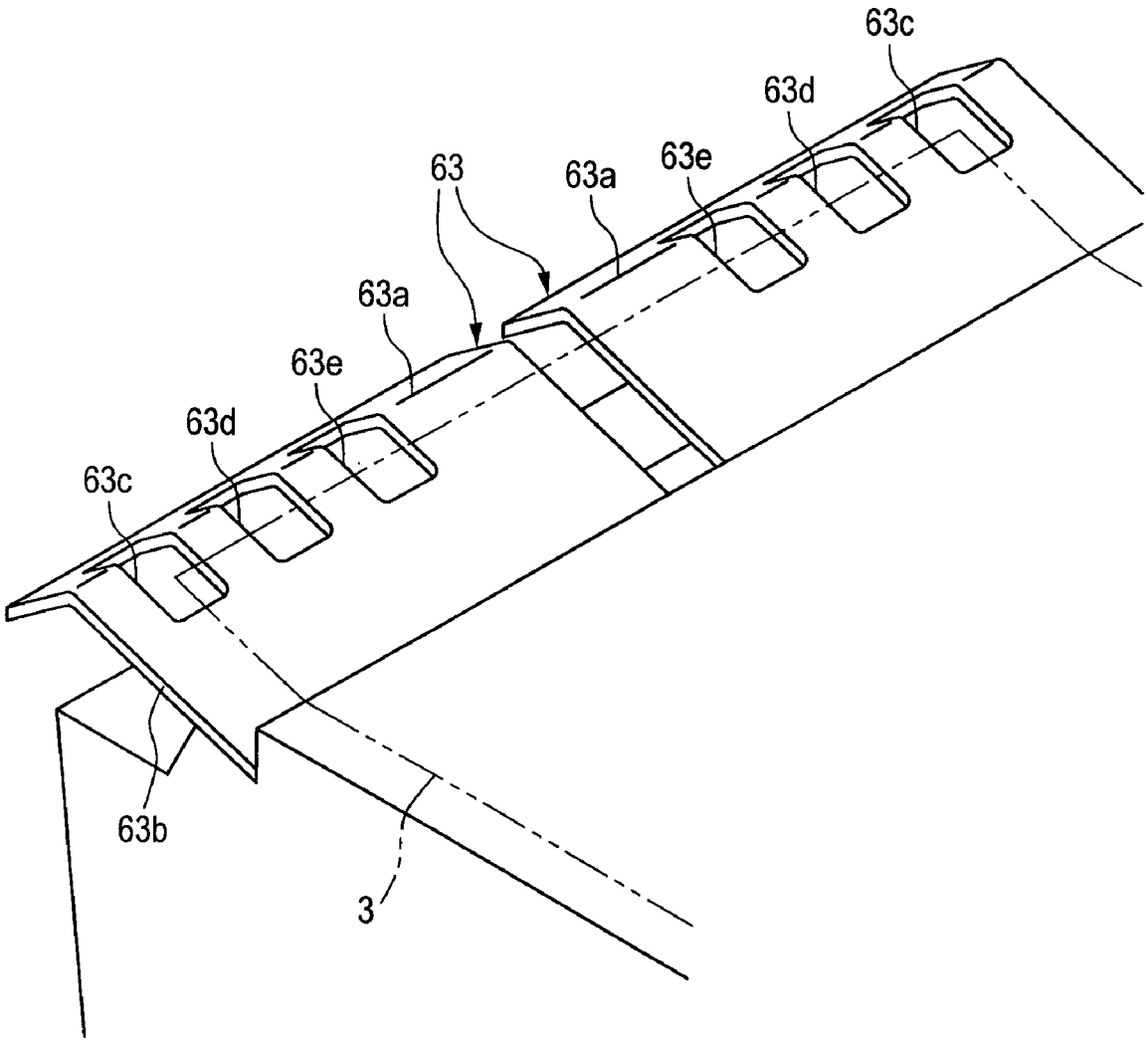
FIG. 5 is a perspective view showing a mode in which slits are formed in the shape of a hole.

In the second embodiment, the respective slits 62*a*, 62*b*, and 62*c* are formed from the distal end of the distal end portion 62*d* of the guide plate 62 to a vicinity of the center of the conveyance portion 62*e*. However, the present invention is not limited to this embodiment. The essential requirement is that the slits should be formed from the distal end side of the guide plate to the base end side of the same. For instance, as shown in FIG. 5, slits 63*c*, 63*d*, and 63*e* may also be formed to a predetermined length from a bent corner portion 63*a* of the guide plate 63 to a base end side of the same. Specifically, the respective slits 63*c*, 63*d*, and 63*e* may also be formed into the shape of a hole. Even in this case, an advantage similar to that yielded by the second embodiment can also be yielded.

The respective slits 62*a*, 62*b*, and 62*c* shown in FIG. 3 are formed to a vicinity of the center of the conveyance portion 62*e*. However, the slits may also be formed so as to pass through the center of the conveyance portion toward the base end side. In other words, narrow guide plates may be provided, and spaces between adjacent guide plates may be positioned in alignment with both widthwise ends of a sheet, such that the spaces between the adjacent guide plates may be utilized as slits.

Example

An example of the first embodiment will be described below. In detail, there are provided results of an experiment conducted with regard to a relationship between an angle of the bent portion in the vicinity of the distal end portion 61*c* of the guide plate 61 and noise.

Various conditions for the experiment of the example are as follows:

(1) Material for the guide plate 61: Polyethylene Terephthalate;

(2) Size of the guide plate 61: a longitudinal width of 11.00 mm, a lateral width of 105.50 mm, and a thickness of 0.10 mm, where "longitudinal width" means a length of the guide plate 61 along the conveying direction of the sheet 3 among the directions on the guide surface 61*a*, "lateral width" means a length of the guide plate 61 orthogonal to the conveying direction of the sheet 3 among the directions on the guide surface 61*a*, and "thickness" designates a length along a direction orthogonal to the guide surface 61*a* of the guide plate 61;

(3) An extent of projection of the guide plate 61 from the pedestal 51*a* (except the bent distal end portion 61*c*); 6.00 mm;

(4) Length of the distal end portion 61*c*: 2.00 mm;

(5) Angle of bend of the distal end portion 61*c* of the guide plate 61 (five types (a) to (e) indicated below), where "angle of bend of the distal end portion 61*c* of the guide plate 61" means an angle defined between the guide surface 61*a* and the distal end surface 610*c* of the guide plate 61 the lower surface 61*d* side:

(a) 180° (no bend)

(b) 98°

(c) 99°

(d) 107°

(e) 110°

(6) Number of guide plates 61: two;

(7) Type of sheet 3: A4-size plain paper of 80 g/m$^2$; and (8) Number of measurement operations: 10 operations.

The reason why variations exist in the angle of bend is that an angle becomes greater than a target value for reasons of restoration force of the guide plate 61 that is an elastic element. For instance, (b) shows that, although the distal end portion of the guide plate is bent while a target angle of bend is taken as 90°, the distal end portion becomes stable after having returned to an angle of 98° by means of restoration force of the guide plate 61.

An experiment was conducted under the foregoing conditions, to thus have examined a relationship between the angle of bend of the distal end portion of the guide plate and noise. In relation to a test method, noise generated by a printer is recorded at every 10 [ms], and the value of noise generated when a sheet passes over the guide plate is read. Consequently, experimental results, such as those shown in FIG. 6, are obtained.

Figure 6:
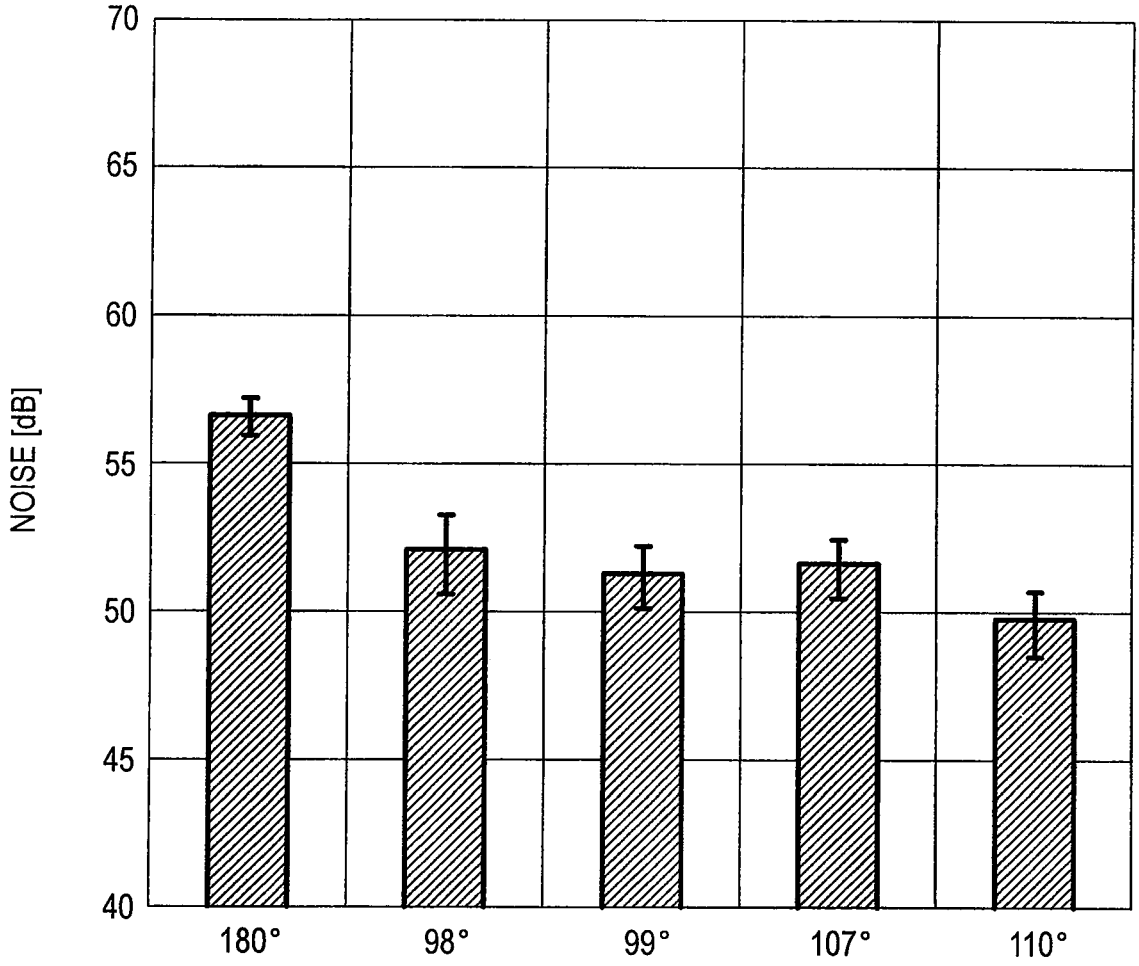
FIG. 6 is a graph showing a relationship between an angle of bend of a distal end portion of the guide plate and noise.

FIG. 6 is a plot showing a relationship between an angle of bend of the distal end portion of the guide plate and noise. A bar chart shown in FIG. 6 indicates an average value of measured noise, and lines plotted in neighborhoods of extremities of the bar charts indicates a range from the maximum measured value to the minimum measured value of noise.

According to the experimental result shown in FIG. 6, noise is ascertained to be suppressed in the cases where the distal end portion is bent to angles of 98°, 99°, 107°, and 110° when compared with the case of no bend (180°). Specifically, an average level of noise achieved when the angle of bend is 180° is 56.69 [dB]. An average level of noise achieved when the angle of bend is 98° is 52.03 [dB]. An average level of noise achieved when the angle of bend is 99° is 51.27 [dB]. An average level of noise achieved when the angle of bend is 107° is 51.57 [dB]. An average level of noise achieved when the angle of bend is 110° is 49.78 [dB].

As mentioned above, a reliable reduction in noise was ascertained by means of setting the angle of bend to a value of 110° or less.

What is claimed is:

1. A process cartridge comprising:

an image carrier configured to carry a developer image and having a transfer position capable of transferring the developer image to a recording sheet;

a cantilever-shaped guide plate including a distal end portion being unsupported, and having a first surface and a second surface that is opposite to the first surface; and a pedestal configured to support an end of the cantilever-shaped guide plate remote from the distal end, wherein a leading end of the recording sheet is guided on the first surface in a conveying direction, such that the leading end is guided toward the transfer position after the leading end is brought into contact with the image carrier, wherein the distal end portion of the guide plate is bent toward the second surface side to form a bent portion, and wherein the cantilever-shaped guide plate is more elastically deformable than the pedestal.

2. The process cartridge according to claim 1, wherein the guide plate includes a first portion having the first surface and the second surface, a second portion including a distal end of the guide plate, and the bent portion that connects the first portion and the second portion, wherein the second portion has a third surface continuous with the first surface, and wherein an angle defined between the first surface and the third surface on the second surface side is 120 degrees or less.

3. The process cartridge according to claim 1, wherein the guide plate includes a first portion having the first surface and the second surface, a second portion including a distal end of the guide plate, and the bent portion that connects the first portion and the second portion, wherein the second portion has a third surface continuous with the first surface, and wherein an angle defined between the first surface and the third surface on the second surface side is 110 degrees or less.

4. The process cartridge according to claim 1, wherein the guide plate has slits formed at positions corresponding to both ends of the recording sheet in a widthwise direction orthogonal to the conveying direction.

5. The process cartridge according to claim 4, wherein the slits are formed in numbers of pairs corresponding to a plurality of sizes of the recording sheets.

6. The process cartridge according to claim 1, wherein the guide plate includes a first portion having the first surface and the second surface, a second portion including a distal end of the guide plate, and the bent portion that connects the first portion and the second portion, wherein the second portion is further bent toward a downstream in the conveying direction.

7. The process cartridge according to claim 1, wherein the guide plate includes a first portion having the first surface and the second surface, a second portion including a distal end of the guide plate, and the bent portion that connects the first portion and the second portion, wherein the second portion is further bent toward an upstream in the conveying direction.

8. The process cartridge according to claim 1, wherein the process cartridge is configured to accept recording sheets having a range of stiffness including a minimum stiffness and a maximum stiffness, such that the elasticity of the guide plate is stiffer than the minimum stiffness and less stiff than the maximum stiffness.

9. The process cartridge according to claim 1, wherein the guide plate has a geometrical moment of inertia I and a Young's modulus, such that a product EI is within the range of $3.49\times10^{-5}$ to $1.18\times10^{-3}$ ($N\cdot m^2$).

10. The process cartridge according to claim 1, wherein the cantilever-shaped guide plate is formed of an elastically-deformable material.

11. A process cartridge comprising:

an image carrier configured to carry a developer image and having a transfer position capable of transferring the developer image to a recording sheet; and an elastically-deformable cantilever-shaped guide plate including a distal end portion being unsupported, and having a first surface and a second surface that is opposite to the first surface, wherein a leading end of the recording sheet is configured to be guided on the first surface in a conveying direction, such that the leading end is configured to be guided toward the transfer position after the leading end is brought into contact with the image carrier, wherein the distal end portion of the guide plate is bent toward the second surface side to form a bent portion, wherein the guide plate has slits formed at positions corresponding to both ends of the recording sheet in a widthwise direction orthogonal to the conveying direction, wherein the guide plate includes a first portion having the first surface and the second surface, a second portion including a distal end of the guide plate, and the bent portion that connects the first portion and the second portion, and wherein each of the slits extends from the bent portion toward the first portion and the second portion.

12. The process cartridge according to claim 11, wherein each of the slits extends from the bent portion to the distal end of the second portion.

13. An image forming apparatus comprising:

a mounting portion; and a process cartridge configured to be removably attached to the mounting portion, the process cartridge including:

an image carrier configured to carry a developer image and having a transfer position capable of transferring the developer image to a recording sheet;

a cantilever-shaped guide plate including a distal end portion being unsupported, and having a first surface and a second surface that is opposite to the first surface; and a pedestal configured to support an end of the cantilever-shaped guide plate remote from the distal end, wherein the process cartridge is configured to guide a leading end of the recording sheet on the first surface in a conveying direction, such that the leading end is guided toward the transfer position after the leading end is brought into contact with the image carrier, wherein the distal end portion of the guide plate is bent toward the second surface side to form a bent portion, wherein the cantilever-shaped guide plate is more elastically deformable than the pedestal.

14. The image forming apparatus according to claim 13, wherein the process cartridge is configured to accept recording sheets having a range of stiffness including a minimum stiffness and a maximum stiffness, such that the elasticity of the guide plate is stiffer than the minimum stiffness and less stiff than the maximum stiffness.

15. The image forming apparatus according to claim 13, wherein the guide plate has a geometrical moment of inertia I and a Young's modulus, such that a product EI is within the range of $3.49\times10^{-5}$ to $1.18\times10^{-3}$ ($N\cdot m^2$).

16. The image forming apparatus according to claim 13, further comprising:

a pedestal configured to support an end of the cantilever-shaped guide plate remote from the distal end, wherein the cantilever-shaped guide plate is more elastically deformable than the pedestal.

17. The image forming apparatus according to claim 13, wherein the cantilever-shaped guide plate is formed of an elastically-deformable material.

18. An image forming apparatus comprising:

a main body;

an image carrier configured to carry a developer image and having a transfer position capable of transferring the developer image to a recording sheet;

a cantilever-shaped guide plate including a distal end portion being unsupported, and having a first surface and a second surface that is opposite to the first surface; and a pedestal configured to support an end of the cantilever-shaped guide plate remote from the distal end, wherein the guide plate is configured to guide a leading end of the recording sheet on the first surface in a conveying direction, such that the leading end is guided toward the transfer position after the leading end is brought into contact with the image carrier, wherein the distal end portion of the guide plate is bent toward the second surface side to form a bent portion, wherein the guide plate is provided at the main body, and wherein the cantilever-shaped guide plate is more elastically deformable than the pedestal.

19. The image forming apparatus according to claim 18, wherein the process cartridge is configured to accept recording sheets having a range of stiffness including a minimum stiffness and a maximum stiffness, such that the elasticity of the guide plate is stiffer than the minimum stiffness and less stiff than the maximum stiffness.

20. The image forming apparatus according to claim 18, wherein the guide plate has a geometrical moment of inertia I and a Young's modulus, such that a product EI is within the range of $3.49\times10^{-5}$ to $1.18\times10^{-3}$ ($N\cdot m^2$).

21. The image forming apparatus according to claim 18, wherein the cantilever-shaped guide plate is formed of an elastically-deformable material.

* * * * *